US009574571B2

(12) United States Patent
Kawano et al.

(10) Patent No.: US 9,574,571 B2
(45) Date of Patent: Feb. 21, 2017

(54) PUMP DEVICE AND PUMP SYSTEM

(71) Applicant: Panasonic Corporation, Kadoma-shi, Osaka (JP)

(72) Inventors: Bunki Kawano, Osaka (JP); Kou Komori, Nara (JP); Tomoichiro Tamura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 792 days.

(21) Appl. No.: 14/005,491

(22) PCT Filed: Oct. 5, 2012

(86) PCT No.: PCT/JP2012/006448
§ 371 (c)(1),
(2) Date: Sep. 16, 2013

(87) PCT Pub. No.: WO2013/051290
PCT Pub. Date: Apr. 11, 2013

(65) Prior Publication Data

US 2014/0056696 A1 Feb. 27, 2014

(30) Foreign Application Priority Data

Oct. 6, 2011 (JP) ..... 2011-222242

(51) Int. Cl.
*F04D 27/00* (2006.01)
*F04D 29/42* (2006.01)
(Continued)

(52) U.S. Cl.
CPC ..... *F04D 27/002* (2013.01); *F04D 27/0246* (2013.01); *F04D 29/4213* (2013.01);
(Continued)

(58) Field of Classification Search
CPC .. F04D 27/002; F04D 27/0246; F04D 27/009; F04D 29/4213; F04D 29/4273; F04D 29/685; F04D 29/688
See application file for complete search history.

(56) References Cited

U.S. PATENT DOCUMENTS 7,942,625 B2 * 5/2011 Sirakov ..... F04D 29/4213 415/56.5
2008/0247866 A1 * 10/2008 Sirakov ..... F04D 29/4213 415/144
2012/0121400 A1 5/2012 Tomita et al.

FOREIGN PATENT DOCUMENTS

JP 7-174098 7/1995
JP 2001-165025 6/2001
(Continued)

*Primary Examiner* — Gregory Anderson
*Assistant Examiner* — Maxime Adjagbe
(74) *Attorney, Agent, or Firm* — Hamre, Schumann, Mueller & Larson, P.C.

(57) ABSTRACT

A pump device (1A) includes: an impeller (2) that rotates about an axis of rotation (A); an inlet passage (10*a*) that extends along the axis of rotation (A) of the impeller (2); a volute chamber (10*b*) provided around the impeller (2); a high-pressure chamber (4) provided around the inlet passage (10*a*); a circumferential wall (5) that separates the inlet passage (10*a*) and the high-pressure chamber (4); and a bypass passage (6) that communicates the volute chamber (10*b*) and the high-pressure chamber (4). The circumferential wall (5) has a plurality of through holes (51) provided in a circumferential direction. The central axis (B) of each of the through holes (51) is included in a plane substantially perpendicular to the axis of rotation (A). The central axis (B) is inclined with respect to a reference line (L). The direction of inclination of the central axis (B) with respect to the reference line (L) is determined so that an inlet passage side opening (51*q*) of the through hole (51) is located down-
(Continued)

stream from a high-pressure chamber (4) side opening (51*p*) in a rotational direction of the impeller (2).

10 Claims, 12 Drawing Sheets

(51) Int. Cl.
*F04D 29/68* (2006.01)
*F04D 27/02* (2006.01)

(52) U.S. Cl.
CPC ..... *F04D 29/4273* (2013.01); *F04D 29/685* (2013.01); *F04D 29/688* (2013.01)

(56) References Cited

FOREIGN PATENT DOCUMENTS

| | | |
|---|---|---|
| JP | 2003-314496 | 11/2003 |
| JP | 2008-309029 | 12/2008 |
| JP | 4454456 | 2/2010 |
| JP | 2010-174806 | 8/2010 |
| JP | 2011-085095 | 4/2011 |

* cited by examiner

| | | Number of revolutions of pump [rpm] | | | | | |
|---|---|---|---|---|---|---|---|
| | | 1500 | 1800 | 2100 | 2400 | 2700 | 3000 |
| Flow rate [L/min] | 30 | $X_{1,1}$ | $X_{1,2}$ | | | $X_{1,n-1}$ | $X_{1,n}$ |
| | 35 | $X_{2,1}$ | | | | | |
| | 40 | | | | | | |
| | 45 | | | | | | |
| | 50 | | | | | | |
| | 55 | | | | | | |
| | 60 | | | | | | |
| | 65 | | | | | | |
| | 70 | | | | | | |
| | 75 | | | | | | |
| | 80 | | | | | | |
| | 85 | $X_{m-1,1}$ | | | | | |
| | 90 | $X_{m,1}$ | | | | | $X_{m,n}$ |

FIG.7A

| | | Number of revolutions of pump [rpm] | | | | | |
|---|---|---|---|---|---|---|---|
| | | 1500 | 1800 | 2100 | 2400 | 2700 | 3000 |
| Discharge pressure [kPa] | 5 | $X_{1,1}$ | $X_{1,2}$ | | | $X_{1,n-1}$ | $X_{1,n}$ |
| | 10 | $X_{2,1}$ | | | | | |
| | 15 | | | | | | |
| | 20 | | | | | | |
| | 25 | | | | | | |
| | 30 | | | | | | |
| | 35 | | | | | | |
| | 40 | | | | | | |
| | 45 | | | | | | |
| | 50 | | | | | | |
| | 55 | | | | | | |
| | 60 | $X_{m-1,1}$ | | | | | |
| | 65 | $X_{m,1}$ | | | | | $X_{m,n}$ |

FIG.7B

| | | Number of revolutions of pump [rpm] | | | | | |
|---|---|---|---|---|---|---|---|
| | | 1500 | 1800 | 2100 | 2400 | 2700 | 3000 |
| Motor torque [Nm] | 0.10 | $X_{1,1}$ | $X_{1,2}$ | | | $X_{1,n-1}$ | $X_{1,n}$ |
| | 0.12 | $X_{2,1}$ | | | | | |
| | 0.14 | | | | | | |
| | 0.16 | | | | | | |
| | 0.18 | | | | | | |
| | 0.20 | | | | | | |
| | 0.22 | | | | | | |
| | 0.24 | | | | | | |
| | 0.26 | | | | | | |
| | 0.28 | | | | | | |
| | 0.30 | | | | | | |
| | 0.32 | $X_{m-1,1}$ | | | | | |
| | 0.34 | $X_{m,1}$ | | | | | $X_{m,n}$ |

FIG.9A

| | | Number of revolutions of pump [rpm] | | | | | |
|---|---|---|---|---|---|---|---|
| | | 1500 | 1800 | 2100 | 2400 | 2700 | 3000 |
| Motor current [A] | 0.2 | $X_{1,1}$ | $X_{1,2}$ | | | $X_{1,n-1}$ | $X_{1,n}$ |
| | 0.4 | $X_{2,1}$ | | | | | |
| | 0.6 | | | | | | |
| | 0.8 | | | | | | |
| | 1.0 | | | | | | |
| | 1.2 | | | | | | |
| | 1.4 | | | | | | |
| | 1.6 | | | | | | |
| | 1.8 | | | | | | |
| | 2.0 | | | | | | |
| | 2.2 | | | | | | |
| | 2.4 | $X_{m-1,1}$ | | | | | |
| | 2.6 | $X_{m,1}$ | | | | | $X_{m,n}$ |

FIG.9B

PUMP DEVICE AND PUMP SYSTEM

TECHNICAL FIELD

The present invention relates to a pump device for pumping a liquid and a pump system using this pump device.

BACKGROUND ART

Conventionally, in heat transport devices for circulating liquids such as water and alcohol and various other devices involving transfer of liquids, pump devices for pumping liquids by rotation of impellers are widely used. For example, Patent Literature 1 discloses a pump device 100 for use in a pumped storage power plant, as shown in FIG. 10.

This pump device 100 includes an impeller 120 and a suction pipe 110 that forms an inlet passage for introducing water into this impeller 120. A nozzle 130 for injecting high-pressure water toward the impeller 120 is disposed in the inlet passage, and a feed pipe 140 penetrating the inlet pipe 110 is connected to the nozzle 130. In the pump device 100 for use in a pumped storage power plant, cavitation develops as the pump head (pumping height) increases. The nozzle 130 is designed to improve this problem.

In one embodiment of Patent Literature 1, the opening direction of the nozzle 130 is parallel to the axis of rotation of the impeller 120, as shown in FIG. 11A. When the pump head increases, the flow rate decreases and the water inlet angle $\beta$ into the impeller 120 becomes smaller than the blade angle $\beta_0$ of the impeller 120, as shown in FIG. 11B. So, high-pressure water is injected from the nozzle 130 to increase the meridional water flow velocity from V to V'. In FIG. 11B, U is the blade rotational velocity, and W and W' are the relative water inlet velocities into the impeller 120. As a result, the water inlet angle changes from $\beta$ to $\beta'$ and approaches the blade angle $\beta_0$. Thus, cavitation is unlikely to be generated.

In another embodiment of Patent Literature 1, the nozzle 130 is configured to swing in the rotational direction of the impeller 120 and in the opposite direction with respect to the axis of rotation of the impeller 120, as shown in FIG. 12A. When the nozzle 130 is swung in the rotational direction of the impeller 120, the flow of water can be converted into a vortex flow in the rotational direction of the impeller 120 before the water enters the impeller 120. When the nozzle 130 is swung in the direction opposite to the rotational direction of the impeller 120, the flow of water can be converted into a vortex flow in the direction opposite to that rotational direction before the water enters the impeller 120. However, also in this embodiment, high-pressure water is still injected from the nozzle 130 to increase the meridional water flow velocity from V to V', as shown in FIG. 12B.

On the other hand, for example, Patent Literature 2 discloses a refrigerating apparatus 300 as shown in FIG. 13 as another apparatus using a pump device. In this refrigerating apparatus 300, water as a refrigerant is circulated. Specifically, the refrigerating apparatus 300 has a main circuit 310 in which an evaporator 311, a compressor 312, and a condenser 313 are connected in this order. Water is retained in the evaporator 311 and the condenser 313. The compressor 312 draws water vapor from the evaporator 311, compresses the vapor, and discharges the compressed vapor to the condenser 313. The water retained in the evaporator 311 is circulated through a heat absorbing circuit 320 via a loading portion 321. The water retained in the condenser 313 is circulated through a heat dissipating circuit 330 via a cooling tower 331. The heat absorbing circuit 320 and the heat dissipating circuit 330 are each provided with a pump device 200.

CITATION LIST

Patent Literature
Patent Literature 1: JP 2001-165025 A
Patent Literature 2: JP 4454456 B2

SUMMARY OF INVENTION

Technical Problem

It is an object of the present invention to provide a pump device capable of reducing the required net positive suction head.

Solution to Problem

In order to solve the above problem, the pump device disclosed by the present invention includes: an impeller that rotates about an axis of rotation; an inlet passage that extends along the axis of rotation; a volute chamber provided around the impeller; a high-pressure chamber provided around the inlet passage; a circumferential wall that separates the inlet passage and the high-pressure chamber; and a bypass passage that communicates the volute chamber and the high-pressure chamber. In this pump device, the circumferential wall has a plurality of through holes provided in a circumferential direction. A central axis of each of the through holes is included in a plane substantially perpendicular to the axis of rotation. When a straight line passing through the axis of rotation and a center of a high-pressure chamber side opening of the through hole and perpendicular to the axis of rotation is defined as a reference line, the central axis is inclined with respect to the reference line. A direction of inclination of the central axis with respect to the reference line is determined so that an inlet passage side opening of the through hole is located downstream from the high-pressure chamber side opening in a rotational direction of the impeller.

Advantageous Effects of Invention

In the pump device configured as described above, a high-pressure liquid introduced from the volute chamber into the high-pressure chamber through the bypass passage is injected through the through-holes from the high-pressure chamber toward the inlet passage. The injection of the high-pressure liquid forces the flow of the liquid to swirl in the rotational direction of the impeller before the liquid enters the impeller. The flow of the high-pressure liquid injected through the through-holes has no component (the component is "0") in the meridional water flow direction in the inlet passage (in the direction parallel to the axis of rotation), or such a component is small enough, if any, compared to the component in the direction perpendicular to that meridional water flow direction. As a result, the relative liquid inlet velocity into the impeller decreases, and thus the required net positive suction head of the pump device can be reduced.

BRIEF DESCRIPTION OF DRAWINGS

FIG. 7A is a diagram showing a map of opening degrees used in the pump system of FIG. 6.

FIG. 7B is a diagram showing a map of opening degrees used in a pump system of a modification.

FIG. 9A is a diagram showing a map of opening degrees used in the pump system of FIG. 8.

FIG. 9B is a diagram showing a map of opening degrees used in a pump system of a modification.

DESCRIPTION OF EMBODIMENTS

Generally, the required net positive suction head (NPSHr) of a pump device provided with an impeller is calculated from the following equation 1. In this equation, $\lambda_V$ and $\lambda_W$ are the coefficients, g is the gravitational acceleration, V, U and W are the meridional water flow velocity, the blade rotational velocity, and the relative water inlet velocity into the impeller, respectively.

$$NPSHr = \lambda_V \frac{V^2}{2g} + \lambda_W \frac{W^2}{2g} \quad \text{[Equation 1]}$$

Figure 13:
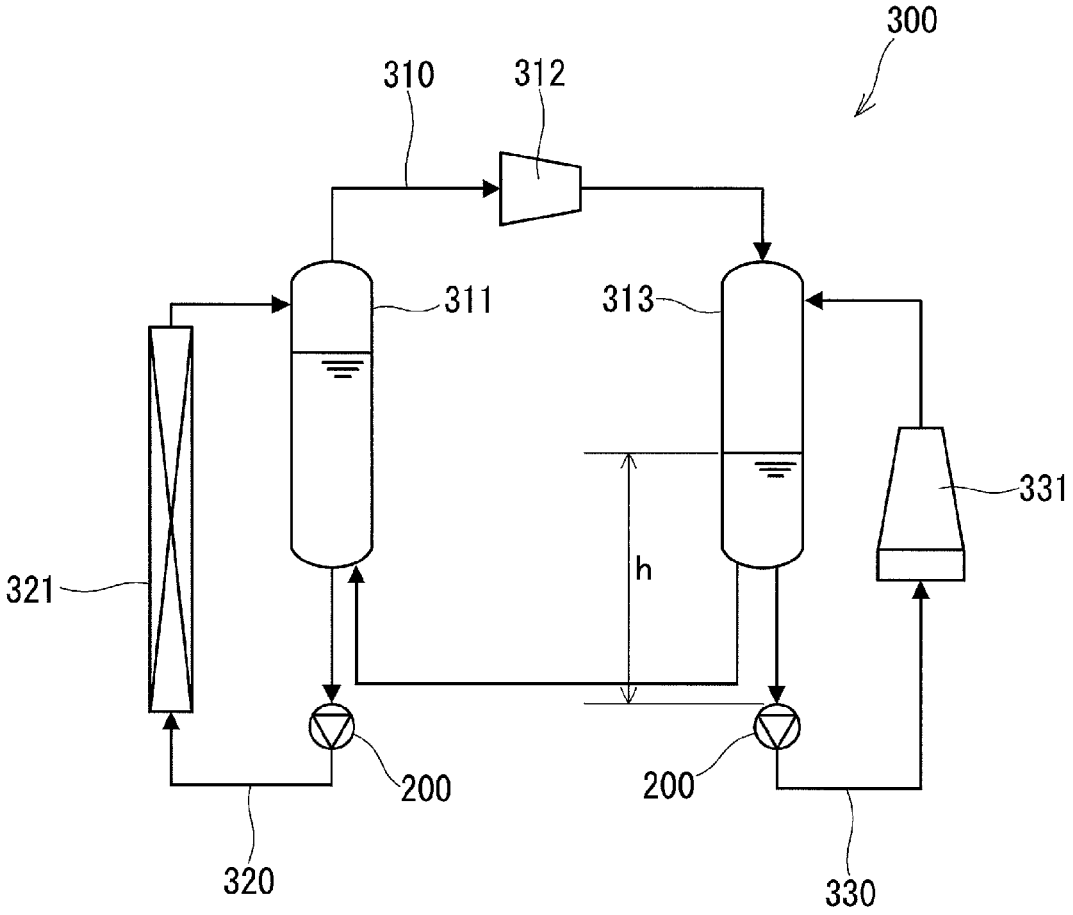
FIG. 13 is a configuration diagram of a refrigerating apparatus using another conventional pump device.

On the other hand, in the refrigerating apparatus 300 shown in FIG. 13, since internal conditions of the evaporator 311 and the condenser 313 are in a saturated state, the height h from the pump device 200 to the water surface in the evaporator 311 or the condenser 313 is the available net positive suction head (NPSHa). Therefore, in order to prevent cavitation in the pump device 200, the size of the refrigerating apparatus 300 needs to be increased. So, the required net positive suction head of the pump device is required to be reduced.

The pump device 100 of Patent Literature 1 is not designed to reduce the required net positive suction head of the pump device 100 itself but is designed to improve the cavitation performance when the pump head increases. In the first place, in Patent Literature 1, a decrease in the flow velocity by an increase in the pump head, in other words, a decrease in the meridional water flow velocity V, is compensated by the injection of high-pressure water from the nozzle 130. This is based on the idea that the first term in Equation 1 is constant. In addition, the relative water inlet velocity W into the impeller 120, that is, the second term in Equation 1, tends to increase due to the injection of high-pressure water from the nozzle 130. Moreover, if water at a temperature close to its saturation temperature is drawn, as in the refrigerating apparatus 300 shown in FIG. 13, the nozzle 130 protruding into the inlet passage may cause cavitation to be generated by collision of water against the nozzle 130.

A first aspect of the present disclosure provides a pump device including: an impeller that rotates about an axis of rotation; an inlet passage that extends along the axis of rotation; a volute chamber provided around the impeller; a high-pressure chamber provided around the inlet passage; a circumferential wall that separates the inlet passage and the high-pressure chamber; and a bypass passage that communicates the volute chamber and the high-pressure chamber, wherein the circumferential wall has a plurality of through holes provided in a circumferential direction, a central axis of each of the through holes is included in a plane substantially perpendicular to the axis of rotation, when a straight line passing through the axis of rotation and a center of a high-pressure chamber side opening of the through hole and perpendicular to the axis of rotation is defined as a reference line, the central axis is inclined with respect to the reference line, and a direction of inclination of the central axis with respect to the reference line is determined so that an inlet passage side opening of the through hole is located downstream from the high-pressure chamber side opening in a rotational direction of the impeller.

A second aspect of the present disclosure provides the pump device as set forth in the first aspect, wherein at least two groups of the plurality of through holes are provided in a direction in which the axis of rotation extends. According to the second aspect, it is possible to make the relative liquid inlet velocity into the impeller uniform and thus further reduce the required net positive suction head of the pump device.

A third aspect of the present disclosure provides the pump device as set forth in the first aspect or the second aspect, further including a flow rate control valve provided in the bypass passage. According to the third aspect, it is possible to perform an operation such that priority is given to the flow rate of the liquid discharged from the pump device when the available net positive suction head is high enough and that the required net positive suction head is reduced when the available net positive suction head is not high enough.

A fourth aspect of the present disclosure provides a pump system including: the pump device of the third aspect; and a controller that adjusts an opening degree of the flow rate control valve.

According to the fourth aspect, it is possible to adjust the opening degree of the flow rate control valve as appropriate.

A fifth aspect of the present disclosure provides the pump system as set forth in the fourth aspect, further including a flow rate detector that detects a flow rate of a liquid drawn into the pump device or discharged from the pump device, wherein the controller increases the opening degree of the flow rate control valve as the flow rate detected by the flow rate detector increases.

According to the fifth aspect, it is possible to maintain the required net positive suction head at a low level in accordance with the flow rate even if the number of revolutions of the motor is constant.

A sixth aspect of the present disclosure provides the pump system as set forth in the fourth aspect, further including a pressure detector that detects a pressure of a liquid discharged from the pump device, wherein the controller decreases the opening degree of the flow rate control valve as the pressure detected by the pressure detector increases.

According to the sixth aspect, it is possible to maintain the required net positive suction head at a low level in accordance with the discharge pressure even if the number of revolutions of the motor is constant.

A seventh aspect of the present disclosure provides the pump system as set forth in the fourth aspect, wherein the pump device includes a motor that drives the impeller, the pump system further includes a torque detector that detects a torque of the motor, and the controller increases the opening degree of the flow rate control valve as the torque detected by the torque detector increases.

According to the seventh aspect, it is possible to maintain the required net positive suction head at a low level in accordance with the motor torque even if the number of revolutions of the motor is constant.

A eighth aspect of the present disclosure provides the pump system as set forth in the fourth aspect, wherein the pump device includes a motor that drives the impeller, the pump system further includes a current detector that detects a current flowing in the motor, and the controller increases the opening degree of the flow rate control valve as the current detected by the current detector increases.

According to the eighth aspect, it is possible to maintain the required net positive suction head at a low level in accordance with the motor current even if the number of revolutions of the motor is constant.

A ninth aspect of the present disclosure provides the pump system as set forth in any one of the fourth to eighth aspects, wherein the pump device includes a motor that drives the impeller, and the controller increases the opening degree of the flow rate control valve as the number of revolutions of the motor increases.

According to the ninth aspect, it is possible to increase or decrease the swirling force to be applied to the flow of the liquid before the liquid enters the impeller 2, in response to an increase or a decrease in the meridional liquid flow velocity and the blade rotational velocity, and thus to maintain the required net positive suction head at a low level even if the number of revolutions of the motor varies.

A tenth aspect of the present disclosure provides the pump system as set forth in any one of the fourth to ninth aspects, wherein the pump system is an air conditioning apparatus in which a refrigerant whose saturated vapor pressure is a negative pressure at ordinary temperature is circulated. According to the tenth aspect, it is possible to provide a pump system that is an air conditioning apparatus.

Hereinafter, embodiments of the present invention will be described with reference to the drawings. The following description relates to exemplary embodiments of the present invention, and the present invention is not limited to these embodiments.

First Embodiment

Figure 1:
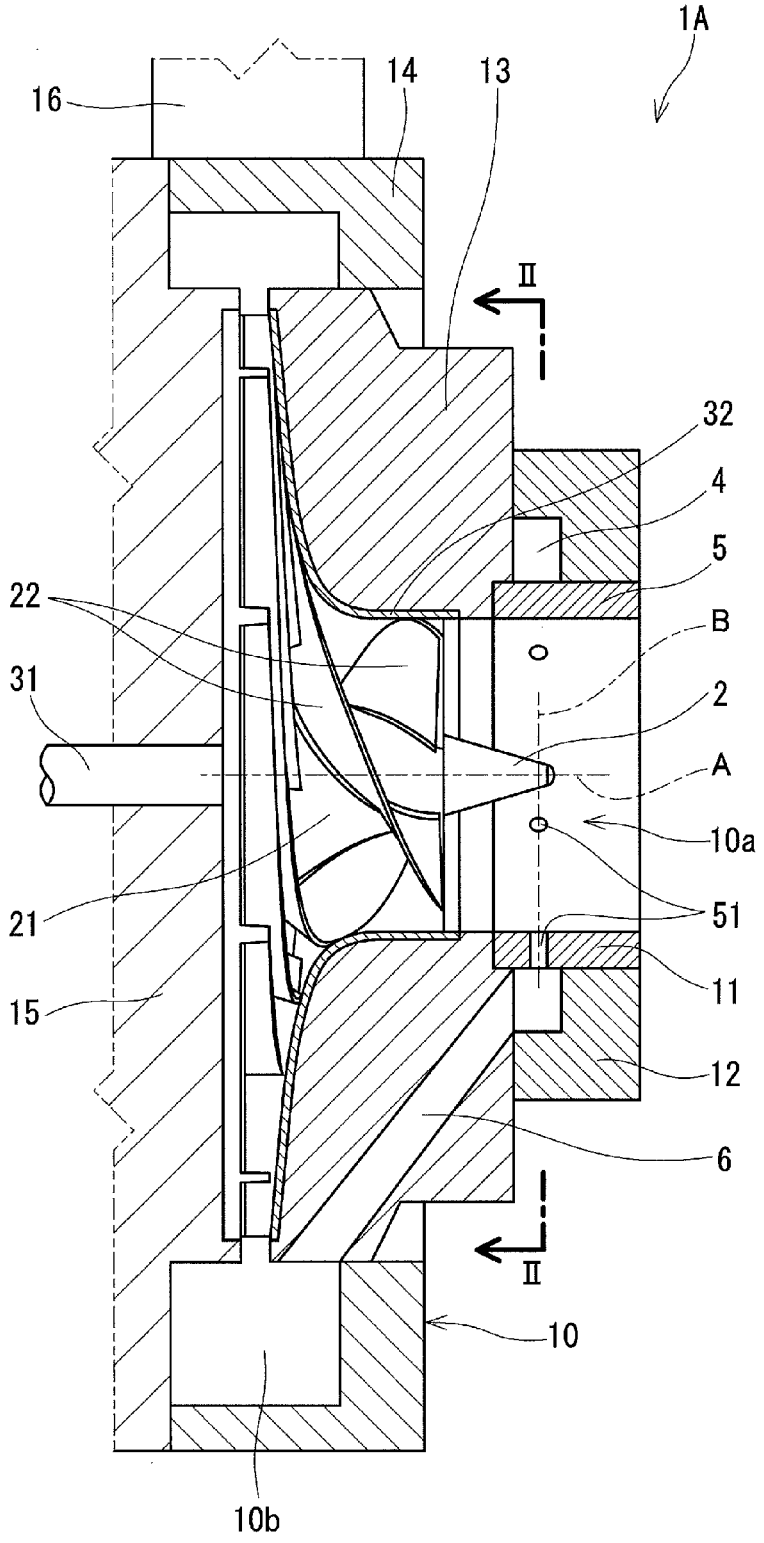
FIG. 1 is a longitudinal sectional view of a pump device according to a first embodiment of the present invention.

FIG. 1 shows a pump device 1A according to the first embodiment of the present invention. This pump device 1A includes a pump body 10, an impeller 2 disposed in the pump body 10, and a motor (not shown) for driving the impeller 2.

The impeller 2 has a hub 21 having a conical shape with a flared base and a plurality of blades 22 formed in a spiral on this hub 21. The impeller 2 is coupled to the motor (not shown) by a shaft 31, and rotates about an axis of rotation A, which is coincident with the central axis of the shaft 31.

The pump body 10 has an inlet passage 10*a* extending along the axis of rotation A of the impeller 2 and a volute chamber 10*b* provided around the impeller 2. The inlet passage 10*a* directs a liquid to the impeller 2, and the volute chamber 10*b* swirls the high-pressure liquid discharged from the impeller 2. The volute chamber 10*b* gradually increases its size in the rotational direction of the impeller 2, and a discharge pipe 16 is connected to the outlet of the volute chamber 10*b* at the end thereof. The pump body 10 also has a high-pressure chamber 4 provided around the inlet passage 10*a*.

In the present embodiment, the pump body 10 includes an inlet pipe 11, a cover 12, a front member 13, a side member 14, and a rear member 15. This configuration may be changed as appropriate. Some of the above components may be joined together as a single member, or a portion of any of these components may be integrated into another component.

The front member 13 is a ring-shaped member located on the front side (on the side of the tapered end of the conical hub 21) of the impeller 2. A shroud 32 having a shape conforming to the tips of the blades 21 is attached to the inner circumferential face and the rear face of the front member 13. The rear member 15 is a disc-shaped member located on the rear side of the impeller 2, and the above-mentioned shaft 31 penetrates the center of the rear member 15. A predetermined space is left between the front member 13 and the rear member 15 around the impeller 2, and the side member 14, the front member 13, and the rear member 15 together form the volute chamber 10*b* communicating with that space.

The inner circumferential face of the front member 13 has an enlarged diameter portion formed on the front side, and the inlet pipe 11 is inserted into this enlarged diameter portion. The inner circumferential face of the inlet pipe 11 forms the inlet passage 10*a*. The cover 12 is a member having an approximately L-shaped cross-section and covering the entire circumference of a corner portion formed by the front face of the front member 13 and the outer circumferential face of the inlet pipe 11. That is, the front face of the front member 13, the outer circumferential face of the inlet pipe 11, and the inner face of the cover 12 form the annular high-pressure chamber 4. In other words, a section of the inlet pipe 11 from a position where the inlet pipe 11 is in contact with the front face of the front member 13 to a position where it is in contact with the cover 12 serves as a circumferential wall 5 that separates the inlet passage 10*a* and the high-pressure chamber 4.

The front member 13 is provided with a hole extending from the outer circumferential face of the front member 13 to the front face thereof so as to approach the axis of rotation A of the impeller 2, and this hole forms a bypass passage 6 that communicates the volute chamber 10*b* and the high-pressure chamber 4. Thus, the high-pressure liquid is introduced from the volute chamber 10*b* into the high-pressure chamber 4 through the bypass passage 6. Preferably, the bypass passage 6 opens into the volute chamber 10*b* near the outlet of the volute chamber 10*b*.

Figure 2:
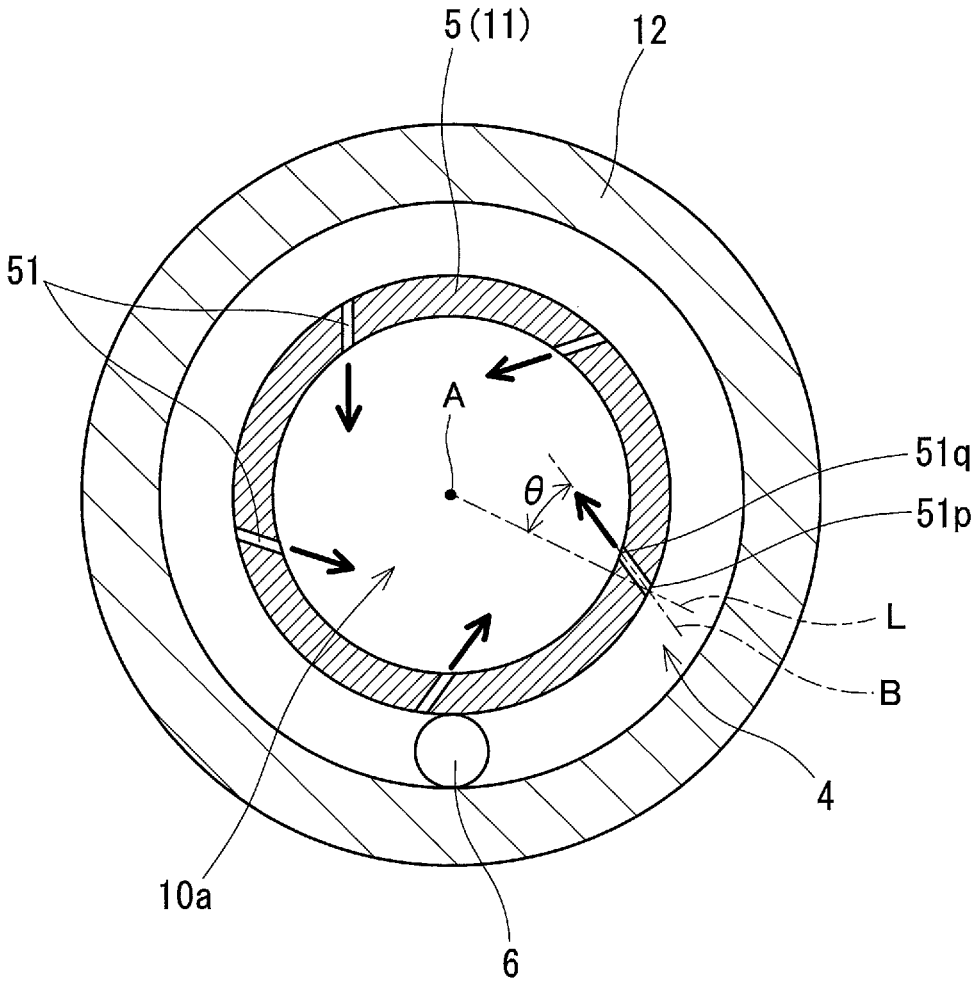
FIG. 2 is a transverse sectional view taken along the line II-II in FIG. 1.

As shown in FIG. 2, the circumferential wall 5 has a plurality of through holes 51 provided in a dispersed manner (preferably at regular angular intervals) in the circumferential direction. The through holes 51 extend from the high-pressure chamber 4 to the inlet passage 10*a* at an angle inclined in the rotational direction of the impeller 2 with respect to the radial direction with the axis of rotation A of the impeller 2 as the center. As shown in FIG. 2, the circumferential wall 5 has the plurality of through holes 51 (preferably at regular angular intervals) in the circumferential direction. The central axis B of each of the through holes 51 is included in a plane substantially perpendicular to the axis of rotation A of the impeller 2. Furthermore, when a straight line passing through the axis of rotation A and the center of the high-pressure chamber 4 side opening 51*p* of the through hole 51 and perpendicular to the axis of rotation A is defined as a reference line L, the central axis B of the through hole 51 is inclined with respect to the reference line L, as shown in FIG. 2. The direction of inclination of the central axis B with respect to the reference line L is determined so that the inlet passage 10*a* side opening 51*q* of the through hole 51 is located downstream from the high-pressure chamber 4 side opening 51*p* in the rotational direction of the impeller 2. Therefore, the pump device 1A injects the high-pressure liquid introduced from the volute chamber 10*b* into the high-pressure chamber 4 through the bypass passage 6, from the high-pressure chamber 4 toward the inlet passage 10*a* through the through-holes 51.

When the central axis B is included in the plane substantially perpendicular to the axis of rotation A, the flow of the high-pressure liquid injected through the through-holes 51 has no component (the component is "0") in the meridional water flow direction in the inlet passage 10*a* (in the direction parallel to the axis of rotation A), or such a component is small enough, if any, compared to the component in the direction perpendicular to that meridional water flow direction. Therefore, a change in the first term in the right-hand side of Equation 1 caused by the flow of the high-pressure liquid injected through the through holes 51 is negligibly small for the required net positive suction head of the pump device 1A. The plane substantially perpendicular to the axis of rotation A is a plane such that a change in the first term in the right-hand side of Equation 1 caused by the flow of the high-pressure liquid is made negligibly small for the required net positive suction head of the pump device 1A because the central axis B is included in that plane. The plane substantially perpendicular to the axis of rotation A includes, for example, a plane inclined at an angle of ±5° with respect to the plane perpendicular to the axis of rotation A. In other words, the central axis B of the through hole 51 may be inclined at an angle of ±5° with respect to the plane perpendicular to the axis of rotation A, for example. Desirably, the central axis B of the through hole 51 is included in the plane perpendicular to the axis of rotation A. The pump device 1A having the through holes 51 provided in this manner can sufficiently enjoy the effect of a reduction in the required net positive suction head of the pump device 1A described below.

The through hole 51 is configured, for example, to reduce the relative velocity of the liquid flowing near the wall of the inlet passage 10*a*. In this case, the direction of the through hole 5*a* defined by an inclination angle θ that is the acute angle between the central axis B and the reference line L is close to the tangential direction of the inner circumferential face of the inlet pipe 11. Instead, the through hole 51 may be inclined in the tangential direction of the path traced by the center of the line between the tip of the blade 22 and the hub 21, or may be inclined inwardly from the tangential direction. The inclination angle θ may be, for example, 45 to 90 degrees. The cross-sectional shape of the through hole 51 perpendicular to the central axis B thereof is circular, for example. However, this shape is not limited to a circular shape. The diameter and number of the through holes 51 can be determined as appropriate.

In the pump device 1A described above, the high-pressure liquid injected through the through holes 51 allows the flow of the liquid to swirl in the rotational direction of the impeller 2 before the liquid enters the impeller 2. As a result, the relative liquid inlet velocity into the impeller 2 decreases, and the required net positive suction head of the pump device 1A can be reduced. In other words, the second term in the right-hand side of Equation 1 decreases, and thereby the required net positive suction head of the pump device 1A can be reduced.

Second Embodiment

Figure 3:
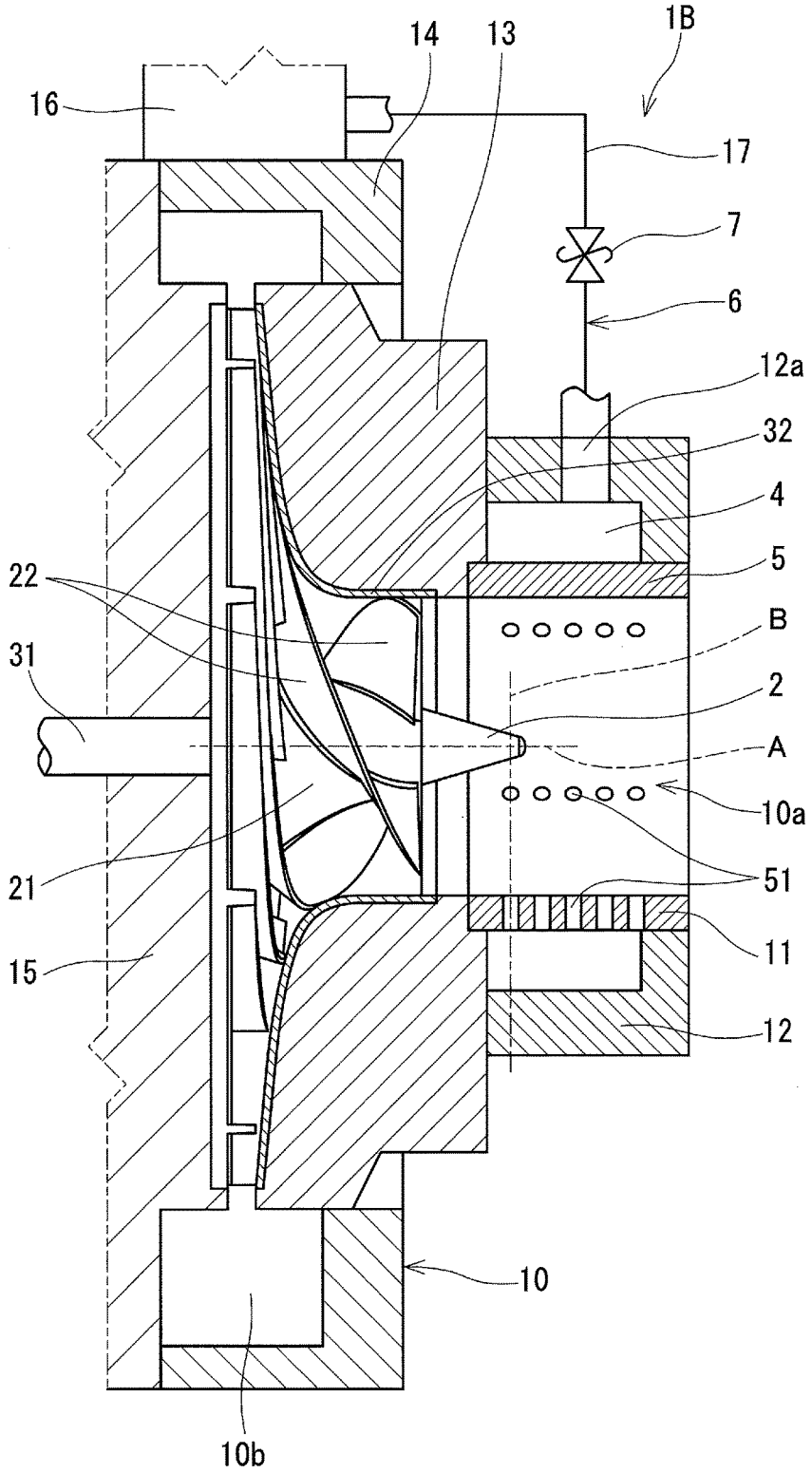
FIG. 3 is a longitudinal sectional view of a pump device according to a second embodiment of the present invention.

Next, a pump device 1B according to the second embodiment of the present invention will be described with reference to FIG. 3. In the present embodiment, the same components as those in the first embodiment are denoted by the same reference numerals, and the description thereof may be omitted.

In the first embodiment, only one group of the through holes 51 is provided, but in the present embodiment, at least two groups of the through holes 51 are provided in a direction in which the axis of rotation 2 of the impeller 2 extends.

Figure 4A:
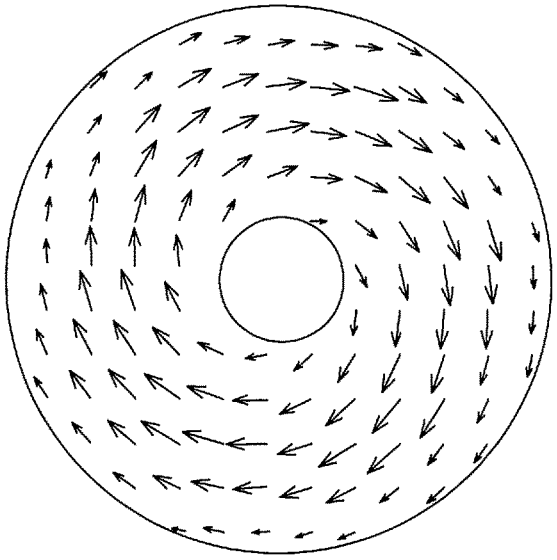
FIG. 4A is a diagram showing a distribution of relative liquid inlet velocities into an impeller in the first embodiment.
Figure 4B:
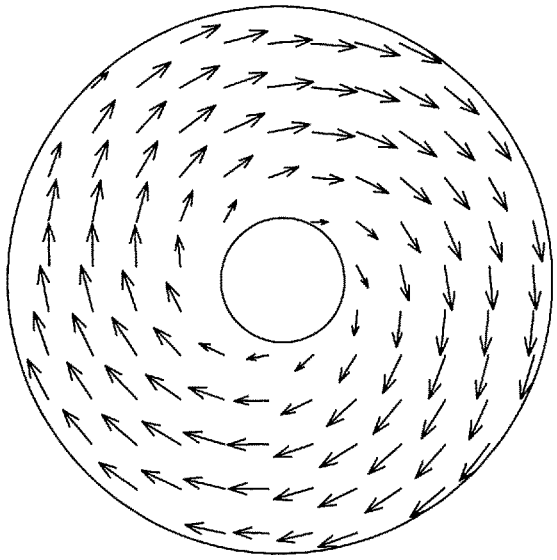
FIG. 4B is a diagram showing a distribution of relative liquid inlet velocities into an impeller in the second embodiment.

When only one group of the through holes is provided as in the first embodiment, the relative liquid inlet velocity into the impeller 2 does not decrease so much in the central region between the tip of the blade 22 and the hub 21, as shown in FIG. 4A, although the relative liquid inlet velocity into the impeller 2 decreases at the tip of the blade 22, which is the environment most vulnerable to cavitation. In contrast, when at least two groups of the through holes are provided as in the present embodiment, the relative liquid inlet velocity into the impeller 2 can be reduced even in the central region between the tip of the blade 22 and the hub 21. As a result, the relative liquid inlet velocity into the impeller 2 can be made more uniform, as shown in FIG. 4B, and thus the required net positive suction head of the pump device 1A can further be reduced.

In the first embodiment, the bypass passage 6 that communicates the volute chamber 10*b* and the high-pressure chamber 4 is provided in the pump body 10. However, in the present embodiment, the bypass passage 6 is exposed outside the pump body 10.

In the present embodiment, the cover 12 is provided with a communication hole 12*a* penetrating the cover 12, and this communication hole 12*a* and the discharge pipe 16 are connected by a communication pipe 17. That is, the discharge pipe 16, the communication pipe 17, and the communication hole 12*a* together form the bypass passage 6 that communicates the volute chamber 10*b* and the high-pressure chamber 4. The bypass passage 6 is provided with a flow rate control valve 7.

When the bypass passage 6 is provided with the flow rate control valve 7, it is possible to perform an operation such that priority is given to the flow rate of the liquid discharged from the pump device 1B when the available net positive suction head is high enough and that the required net positive suction head is reduced when the available net positive suction head is not high enough.

It is also possible to provide the bypass passage 6 inside the pump body 10 so as to provide the flow rate control valve 7 inside the pump body 10, as in the first embodiment.

<Pump System>

Figure 5:
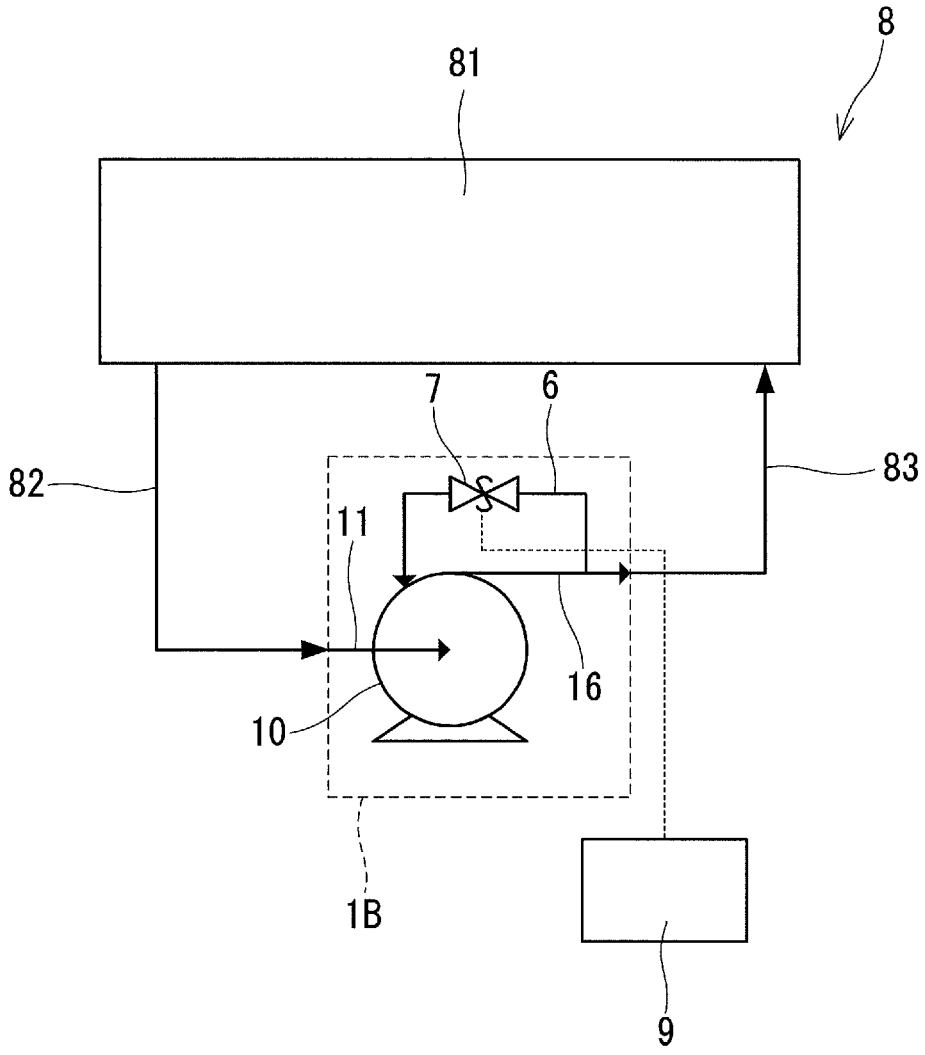
FIG. 5 is a configuration diagram showing an example of a pump system using the pump device shown in FIG. 3.

Next, a pump system 8 using the pump device 1B according to the second embodiment will be described with reference to FIG. 5. This pump system 8 includes a liquid circuit 81 for using a liquid, the pump device 1B, and a controller 9 that adjusts the opening degree of the flow rate control valve 7. The inlet pipe 11 of the pump device 1B and the outlet of the liquid circuit 81 are connected by a first pipe 82, and the discharge pipe 16 of the pump device 1B and the inlet of the liquid circuit 82 are connected by a second pipe 83.

In the present embodiment, the controller 9 increases the opening degree of the flow rate control valve as the number of revolutions of the motor (not shown) of the pump device 1B increases. As a result, it is possible to increase or decrease the swirling force to be applied to the flow of the liquid before the liquid enters the impeller 2 in response to an increase or a decrease in the meridional liquid flow velocity and the blade rotational velocity, and thus to maintain the required net positive suction head at a low level even if the number of revolutions of the motor varies.

Figure 6:
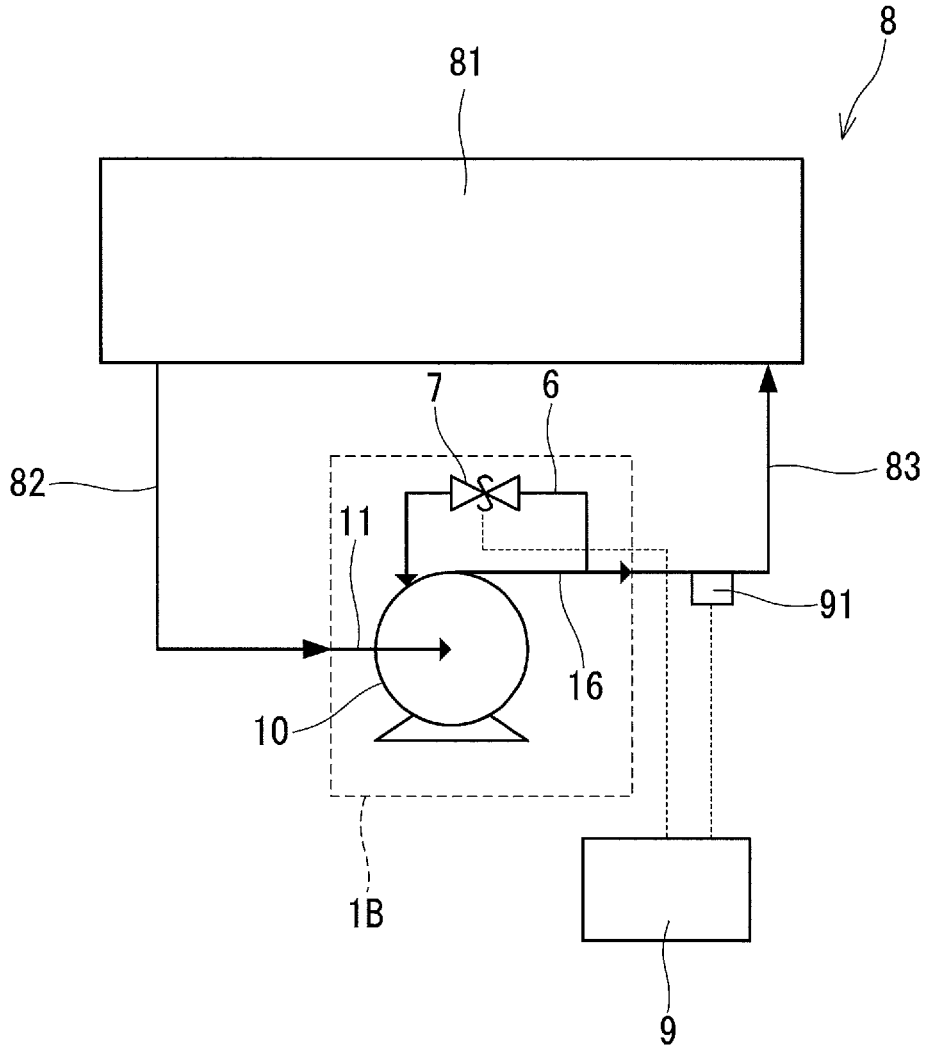
FIG. 6 is a configuration diagram showing another example of the pump system using the pump device shown in FIG. 3.

It is preferable that the pump system 8 is provided with a flow rate detector 91 that detects the flow rate of the liquid discharged from the pump device 1B or drawn into the pump device 1B, as shown in FIG. 6, so that the controller 7 increases the opening degree of the flow rate control valve 7 as the flow rate detected by the flow rate detector 91 increases. In order to achieve this, for example, it is recommended to previously store, in the controller 7, a map of opening degrees in which the opening degree of the flow rate control valve 7 is set for each set of the number of revolutions of the pump and the flow rate, as shown in FIG. 7A. When n different numbers of revolutions of the pump and m different flow rates are set, the opening degree of the flow rate control valve 7 is represented by $X_{ij}$ ($1 \le i \le m$, $1 \le j \le n$), and is gradually increased from $X_{1j}$; to $X_{mj}$. In this configuration, it is possible to maintain the required net positive suction head at a low level in accordance with the flow rate even if the number of revolutions of the motor is constant. In this case, it is also possible to control the flow rate control valve 7 not based on the number of revolutions of the motor but only based on the flow rate.

In the pump system 8 shown in FIG. 6, a pressure detector that detects the pressure of the liquid discharged from the pump device 1B can also be used instead of the flow rate detector 91. In this case, the controller 7 decreases the opening degree of the flow rate control valve 7 as the pressure detected by the pressure detector increases. In order to achieve this, for example, it is recommended to previously store, in the controller 7, a map of opening degrees in which the opening degree of the flow rate control valve 7 is set for each set of the number of revolutions of the pump and the discharge pressure, as shown in FIG. 7B. When n different numbers of revolutions of the pump and m different discharge pressures are set, the opening degree of the flow rate control valve 7 is represented by $X_{ij}$ ($1 \le i \le m$, $1 \le j \le n$), and is gradually decreased from $X_{1j}$ to $X_{mj}$. In this configuration, it is possible to maintain the required net positive suction head at a low level in accordance with the discharge pressure even if the number of revolutions of the motor is constant. In this case, it is also possible to control the flow rate control valve 7 not based on the number of revolutions of the motor but only based on the discharge pressure.

Figure 8:
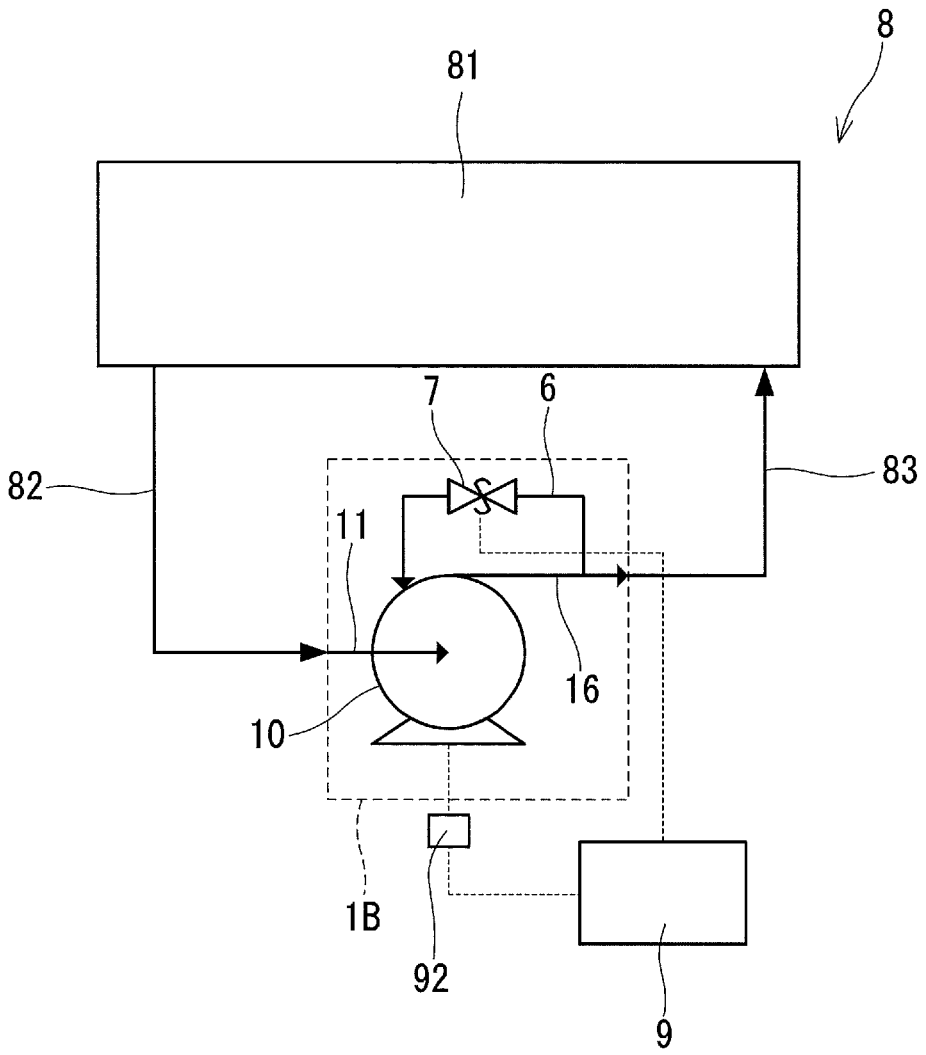
FIG. 8 is a configuration diagram showing still another example of the pump system using the pump device shown in FIG. 3.
Figure 10:
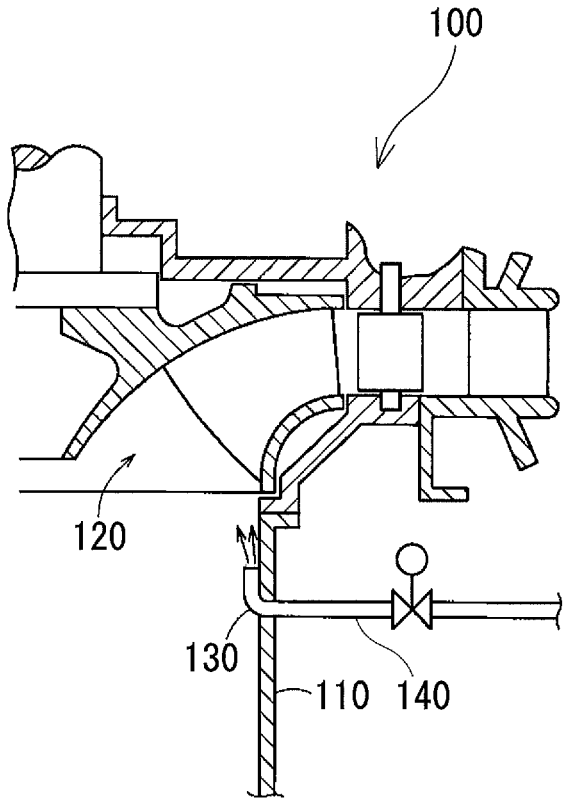
FIG. 10 is a cross-sectional view of a conventional pump device.
Figure 11A:
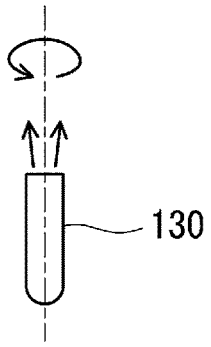
FIG. 11A is a diagram showing the direction of a nozzle in one embodiment of the pump device of FIG. 9.
Figure 11B:
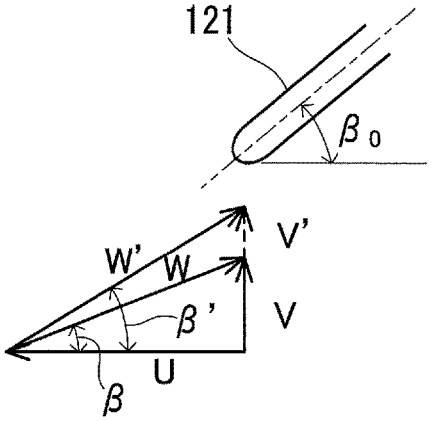
FIG. 11B is a diagram showing the effect obtained by the nozzle.
Figure 12A:
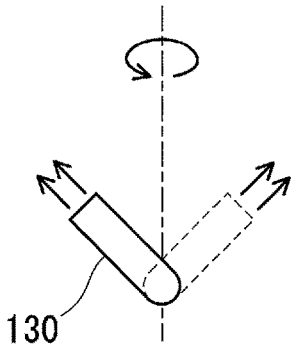
FIG. 12A is a diagram showing the direction of a nozzle in another embodiment of the pump device of FIG. 9.
Figure 12B:
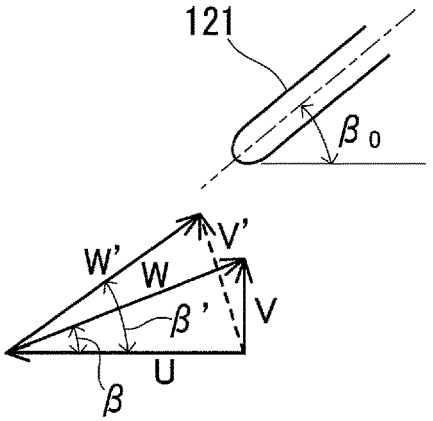
FIG. 12B is a diagram showing the effect obtained by the nozzle.

It is preferable that the pump system 8 is provided with a torque detector 92 that detects the torque of the motor (not shown) of the pump device 1B, as shown in FIG. 8, so that the controller 7 increases the opening degree of the flow rate control valve 7 as the torque detected by the torque detector 92 increases. In order to achieve this, for example, it is recommended to previously store, in the controller 7, a map of opening degrees in which the opening degree of the flow rate control valve 7 is set for each set of the number of revolutions of the pump and the motor torque, as shown in FIG. 9A. When n different numbers of revolutions of the pump and m different motor torques are set, the opening degree of the flow rate control valve 7 is represented by $X_{ij}$($1 \le i \le m$, $1 \le j \le n$), and is gradually increased from $X_{1j}$ to $X_{mj}$. In this configuration, it is possible to maintain the required net positive suction head at a low level in accordance with the motor torque even if the number of revolutions of the motor is constant. In this case, it is also possible to control the flow rate control valve 7 not based on the number of revolutions of the motor but only based on the motor torque.

In the pump system 8 shown in FIG. 8, a current detector that detects the current flowing in the motor (not shown) of the pump device 1B can be used instead of the torque detector 92. In this case, the controller 7 increases the opening degree of the flow rate control valve 7 as the current detected by the current detector increases. In order to achieve this, for example, it is recommended to previously store, in the controller 7, a map of opening degrees in which the opening degree of the flow rate control valve 7 is set for each set of the number of revolutions of the pump and the motor current, as shown in FIG. 9B. When n different numbers of revolutions of the pump and m different motor currents are set, the opening degree of the flow rate control valve 7 is represented by $X_{ij}$ ($1 \le i \le m$, $1 \le j \le n$), and is gradually increased from $X_{1j}$ to $X_{mj}$. In this configuration, it is possible to maintain the required net positive suction head at a low level in accordance with the motor current even if the number of revolutions of the motor is constant. In this case, it is also possible to control the flow rate control valve 7 not based on the number of revolutions of the motor but only based on the motor current.

It is preferable that the above-described pump system 8 be an air conditioning apparatus in which a refrigerant whose saturated vapor pressure is a negative pressure at ordinary temperature (for example, a refrigerant containing water, alcohol or ether as a main component) is circulated. The term "ordinary temperature" refers to a temperature of 20° C.±15° C. The term "main component" refers to a component whose content is the highest in mass. The specific configuration of the air conditioning apparatus is the same as that of the refrigerating apparatus 300 shown in FIG. 13. If an indoor heat exchanger is provided instead of the loading portion 321 and an outdoor heat exchanger is provided instead of the cooling tower 311 in the configuration shown in FIG. 13, a cooling-only air conditioning apparatus can be obtained. If an outdoor heat exchanger is provided instead of the loading portion 321 and an indoor heat exchanger is provided instead of the cooling tower 311 in the configuration shown in FIG. 13, a heating-only air conditioning apparatus can be obtained. If four-way valves or the like are disposed in the heat absorbing circuit 320 and the heat dissipating circuit 330, an air conditioning apparatus capable of switching between cooling and heating can also be obtained.

The invention claimed is:

1. A pump device, comprising:

an impeller that rotates about an axis of rotation;

an inlet passage that extends along the axis of rotation;

a volute chamber provided around the impeller;

a high-pressure chamber provided around the inlet passage;

a circumferential wall that separates the inlet passage and the high-pressure chamber; and a bypass passage that bypasses the inlet passage and communicates the volute chamber and the high-pressure chamber, wherein the circumferential wall has a plurality of through holes provided in a circumferential direction, a central axis of each of the through holes is included in a plane substantially perpendicular to the axis of rotation, when a straight line passing through the axis of rotation and a center of a high-pressure chamber side opening of the through hole and perpendicular to the axis of rotation is defined as a reference line, the central axis is inclined with respect to the reference line, and a direction of inclination of the central axis with respect to the reference line is determined so that an inlet passage side opening of the through hole is located downstream from the high-pressure chamber side opening in a rotational direction of the impeller.

2. The pump device according to claim 1, wherein at least two groups of the plurality of through holes are provided in a direction in which the axis of rotation extends.

3. A pump device comprising:

an impeller that rotates about an axis of rotation;

an inlet passage that extends along the axis of rotation;

a volute chamber provided around the impeller;

a high-pressure chamber provided around the inlet passage;

a circumferential wall that separates the inlet passage and the high-pressure chamber;

a bypass passage that communicates the volute chamber and the high-pressure chamber; and a flow rate control valve provided in the bypass passage, wherein the circumferential wall has a plurality of through holes provided in a circumferential direction, a central axis of each of the through holes is included in a plane substantially perpendicular to the axis of rotation, when a straight line passing through the axis of rotation and a center of a high-pressure chamber side opening of the through hole and perpendicular to the axis of rotation is defined as a reference line, the central axis is inclined with respect to the reference line, and a direction of inclination of the central axis with respect to the reference line is determined so that an inlet passage side opening of the through hole is located downstream from the high-pressure chamber side opening in a rotational direction of the impeller.

4. A pump system, comprising:

the pump device according to claim 3; and a controller that adjusts an opening degree of the flow rate control valve.

5. The pump system according to claim 4, further comprising a flow rate detector that detects a flow rate of a liquid drawn into the pump device or discharged from the pump device, wherein the controller increases the opening degree of the flow rate control valve as the flow rate detected by the flow rate detector increases.

6. The pump system according to claim 4, further comprising a pressure detector that detects a pressure of a liquid discharged from the pump device, wherein the controller decreases the opening degree of the flow rate control valve as the pressure detected by the pressure detector increases.

7. The pump system according to claim 4, wherein the pump device comprises a motor that drives the impeller, the pump system further comprises a torque detector that detects a torque of the motor, and the controller increases the opening degree of the flow rate control valve as the torque detected by the torque detector increases.

8. The pump system according to claim 4, wherein the pump device comprises a motor that drives the impeller, the pump system further comprises a current detector that detects a current flowing in the motor, and the controller increases the opening degree of the flow rate control valve as the current detected by the current detector increases.

9. The pump system according to claim 4, wherein the pump device comprises a motor that drives the impeller, and the controller increases the opening degree of the flow rate control valve as the number of revolutions of the motor increases.

10. The pump system according to claim 4, wherein the pump system is an air conditioning apparatus in which a refrigerant whose saturated vapor pressure is a negative pressure at ordinary temperature is circulated.

* * * * *